US005464718A

United States Patent [19]

Kashizaki et al.

[11] Patent Number: 5,464,718

[45] Date of Patent: Nov. 7, 1995

[54] ELECTROPHOTOGRAPHIC PHOTOSENSITIVE MEMBER, PROCESS CARTRIDGE INCLUDING SAME AND ELECTROPHOTOGRAPHIC APPARATUS

[75] Inventors: Yoshio Kashizaki, Yokohama; Akihiro Senoo, Tokyo; Masato Tanaka, Kawasaki, all of Japan

[73] Assignee: Canon Kabushiki Kaisha, Tokyo, Japan

[21] Appl. No.: 359,745

[22] Filed: Dec. 20, 1994

[30] Foreign Application Priority Data

Dec. 24, 1993 [JP] Japan ..... 5-345825

[51] Int. Cl.[6] ..... G03G 5/14; G03G 15/00

[52] U.S. Cl. ..... 430/58; 430/59; 430/60; 430/62; 430/63; 430/64; 355/211; 118/653

[58] Field of Search ..... 430/58, 62, 63, 430/64; 355/211; 118/653

[56] References Cited

U.S. PATENT DOCUMENTS 4,256,822 3/1981 Tarumi et al. ..... 430/62

FOREIGN PATENT DOCUMENTS 0596504 5/1994 European Pat. Off. .
0632334 6/1994 European Pat. Off. .
0609511 8/1994 European Pat. Off. .
2165295 8/1972 Germany .
48-47344 7/1973 Japan .
51-126149 11/1976 Japan .
52-25638 2/1977 Japan .
52-20836 2/1977 Japan .
53-89435 8/1978 Japan .
54-26738 2/1979 Japan .
55-103556 8/1980 Japan .
2-115858 4/1990 Japan .

OTHER PUBLICATIONS

Patent Abstracts of Japan, vol. 12, No. 390 (p–772), Oct. 1988–based on JPA 63–132251.

*Primary Examiner*—Roland Martin
*Attorney, Agent, or Firm*—Fitzpatrick, Cella, Harper & Scinto

[57] ABSTRACT

An electrophotographic photosensitive member is constituted by an electroconductive support, an intermediate layer disposed on the electroconductive support and a photosensitive layer disposed on the intermediate layer. The intermediate layer contains a resin having a specific recurring unit containing polyamide acid structure and/or polyamide acid ester structure. The photosensitive member is effective for providing a process cartridge and an electrophotographic apparatus respectively including the photosensitive member with an excellent photosensitivity and a stable electric potential under any environmental condition.

19 Claims, 1 Drawing Sheet

ELECTROPHOTOGRAPHIC PHOTOSENSITIVE MEMBER, PROCESS CARTRIDGE INCLUDING SAME AND ELECTROPHOTOGRAPHIC APPARATUS

FIELD OF THE INVENTION AND RELATED ART

The present invention relates to an electrophotographic photosensitive member, particularly to an electrophotographic photosensitive member containing an intermediate layer comprising a resin having a specific structure.

The present invention also relates to a process cartridge and an electrophotographic apparatus respectively using the electrophotographic photosensitive member.

Electrophotographic photosensitive members generally have a photosensitive layer formed on an electroconductive support. Such a photosensitive layer is generally a very thin layer. Accordingly, the photosensitive layer has been liable to encountered a problem such that a thickness of the photosensitive layer becomes ununiform or irregular due to defects on the electroconductive support surface, such as scars or contaminant, in some cases. This tendency is particularly pronounced in the case of a so-called function separation-type photosensitive layer, which is predominantly used in recent years, comprising a very thin (e.g., about 0.5 μm-thick) charge generation layer and a charge transport layer.

If the thickness of a photosensitive layer is ununiform, unevenness in electric potential or photosensitivity is naturally caused to occur. As a result, the photosensitive layer is required to be formed in an appropriate thickness as uniform as possible.

The electrophotographic photosensitive member is required to have a stability of light-part potential and dark-part potential in repetitive use as an important characteristic. If these potentials are unstable, a resultant image is liable to have an ununiform image density and also to cause fogs therein.

In order to alleviate the above-mentioned disadvantages, there have been proposed various intermediate layer, disposed between the electroconductive support and the photosensitive layer, having functions of covering defects on the photosensitive member surface, improving adhesion between the electroconductive support and the photosensitive layer, and suppressing carrier injection from the electroconductive support into the photosensitive layer.

Heretofore, there have been proposed various resins for use in the intermediate layer, such as polyamide (as disclosed in Japanese Laid-Open Patent (JP-A) 48-47344 and JP-A 52-25638), polyester (JP-A 52-20836 and JP-A 54-26738), polyurethane (JP-A 53-89435 and JP-A 2-115858), quaternary ammonium-containing acrylic polymer (JP-A 51-126149) and casein (JP-A 55-103556).

However, electrophotographic photosensitive members using the resins as described above in an intermediate layer have been liable to change the electric resistance of the intermediate layer depending on changes in temperature and humidity, so that it has been difficult to prepare an electrophotographic photosensitive member having stable and excellent potential characteristics in an overall environmental condition ranging from low-temperature and low-humidity condition to high-temperature and high-humidity condition and capable of forming an excellent image.

More specifically, in case where the conventional electrophotographic photosensitive member as described above is used repetitively in low-temperature and low-humidity environmental condition in which the electrical resistance of an intermediate layer used is liable to be increased, the intermediate layer is liable to have a residual electric charge, thus resulting in an increase in a light-part potential and a residual potential. As a result, fogs have been caused to occur on copied images in normal development or a resultant image has possessed a poor image density in reversal development, thus failing to successively obtain an image having a prescribed image quality in some cases. On the other hand, in case where the conventional electrophotographic photosensitive member as described above is used repetitively in high temperature and high-humidity environmental condition in which the electrical resistance of an intermediate layer used is liable to be lowered, the intermediate layer is liable to have a lowered barrier function to accelerate carrier injection from the electroconductive support, thus resulting in an lowering in a dark-part potential. As a result, a resultant image has possessed a poor image density in normal development or black spot-like defects (black spots) or fogs have been caused to occur on copied images.

Further, even when the black spot-like defects on the resultant image are remedied by using an appropriate intermediate layer, the electrophotographic photosensitive member per se has caused a lowering in photosensitivity in many cases.

SUMMARY OF THE INVENTION

An object of the present invention is to provide an electrophotographic photosensitive member stably showing excellent potential properties and capable of successively forming a good image at an initial stage under an overall environmental condition including low-temperature and low-humidity condition to high-temperature and high-humidity condition.

Another object of the present invention is to provide an electrophotographic photosensitive member having high sensitivity and capable of providing a good image free from defects by disposing an intermediate layer excellent in adhesive properties and film-forming properties between an electroconductive support and a photosensitive layer.

A further object of the present invention is to provide a process cartridge and an electrophotographic apparatus respectively including the electrophotographic photosensitive member as described above.

According to the present invention, there is provided an electrophotographic photosensitive member, comprising: an electroconductive support, an intermediate layer disposed on the electroconductive support and a photosensitive layer disposed on the intermediate layer, wherein the intermediate layer comprises a resin having at least one of a recurring unit (1) below and a recurring unit (2) below:

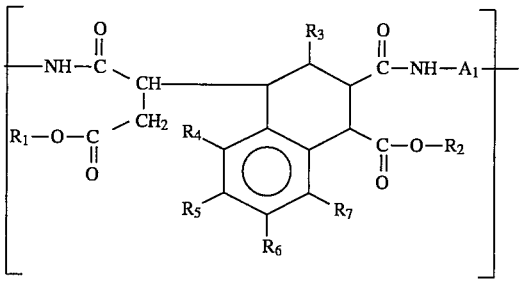

(1)

wherein $A_1$ denotes a divalent organic group; $R_1$ and $R_2$ independently denote hydrogen atom, substituted or unsubstituted alkyl group, substituted or unsubstituted alkoxyalkyl group, or substituted or unsubstituted aralkyl group; and $R_3$ to $R_7$ independently denote hydrogen atom, halogen atom, substituted or unsubstituted alkyl group, substituted or unsubstituted alkoxy group, substituted or unsubstituted aryl group, nitro group, or cyano group; and

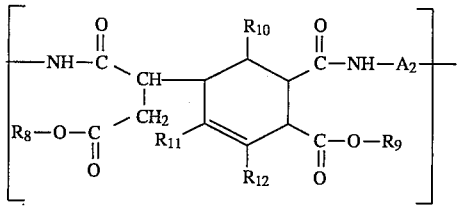

(2)

wherein $A_2$ denotes a divalent organic group; $R_8$ and $R_9$ independently denote hydrogen atom, substituted or unsubstituted alkyl group, substituted or unsubstituted alkoxyalkyl group, or substituted or unsubstituted aralkyl group; $R_{10}$ denotes hydrogen atom, halogen atom, substituted or unsubstituted alkyl group, substituted or unsubstituted alkoxy group, substituted or unsubstituted aryl group, nitro group, or cyano group; and $R_{11}$ and $R_{12}$ independently denote alkyl group.

According to the present invention, there is also provided a process cartridge and an electrophotographic apparatus respectively including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
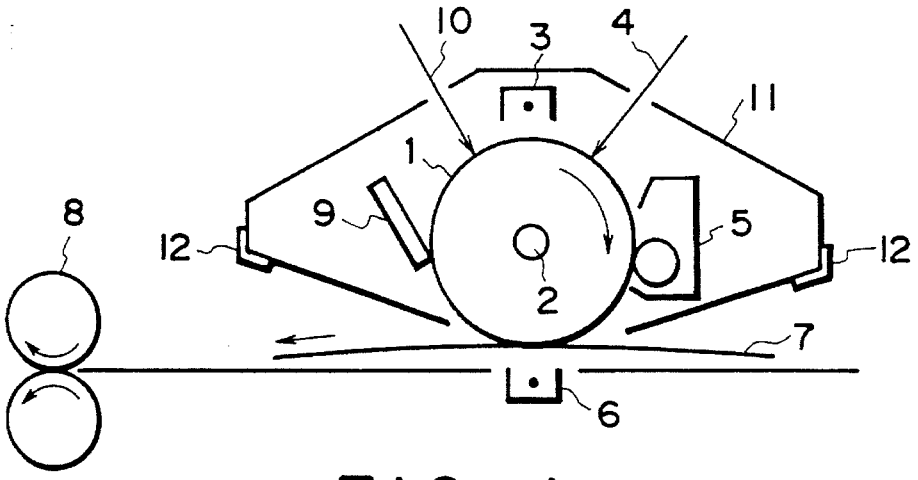
FIG. 1 is a schematic structural view of an electrophotographic apparatus including a process cartridge using an electrophotographic photosensitive member according to the present invention.

The electrophotographic photosensitive member according to the present invention is characterized by an intermediate layer comprising a resin having at least one of the recurring unit (1) and the recurring unit (2) described above.

In the recurring units (1) and (2), examples of $A_1$ and $A_2$ may preferably include various divalent organic groups as described hereinafter, and may particularly include those represented by the following formula (i) and (ii):

$$-Ar_1- \quad \text{(i)},$$

wherein $Ar_1$ denotes substituted or unsubstituted aromatic hydrocarbon group or substituted or unsubstituted heterocyclic group; and $$-Ar_2-Y-Ar_3- \quad \text{(ii)},$$

wherein $Ar_2$ and $Ar_3$ independently denote substituted aromatic hydrocarbon group or substituted or unsubstituted heterocyclic group: and Y denotes oxygen atom, sulfur atom, substituted or unsubstituted alkylene group, carbonyl group or sulfonyl group.

More specific examples of $Ar_1$, $Ar_2$ and $Ar_3$ may include: aromatic hydrocarbon group such as phenylene, biphenylene or naphthylene; and heterocyclic group such as pyridinediyl or thiophenediyl. More specific examples of alkylene group for Y may include methylene, ethylene, propylene or isopropylene- $Ar_1$, $Ar_2$, $Ar_3$ and Y may have a substituent, examples of which may include: alkyl group such as methyl, ethyl or propyl; halogen atom such as fluorine, chlorine or bromine; haloalkyl group such as trifluoromethyl; alkoxy group such as methoxy, ethoxy or propoxy; alkylamino group such as dimethylamino or diethylamino; acyl group such as acetyl or benzoyl; and cyano group.

Preferred and non-exhaustive examples of $A_1$ and $A_2$ (i.e., divalent organic group) may include those shown below, to which $A_1$ and $A_2$ are not restricted.

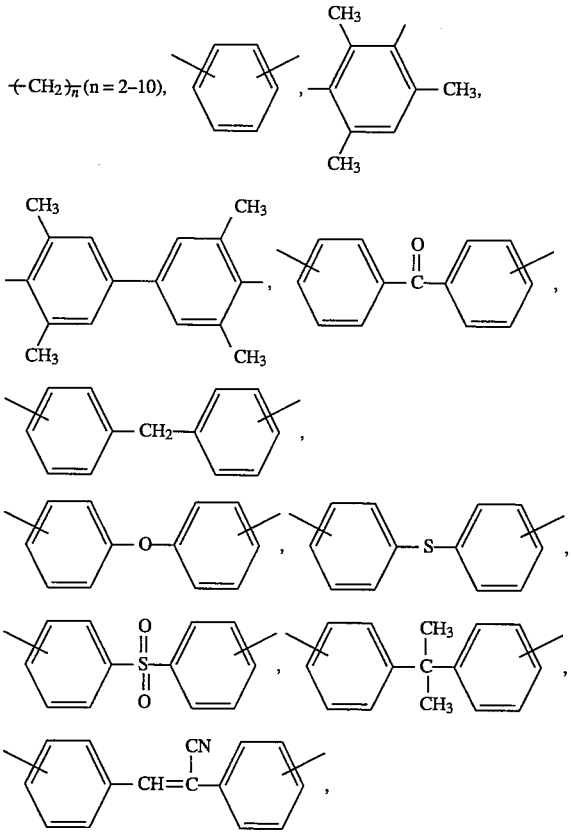

-continued
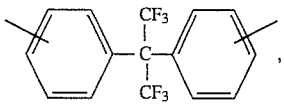
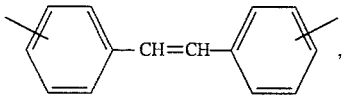
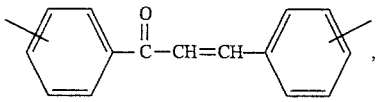
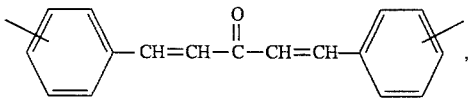
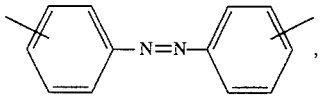
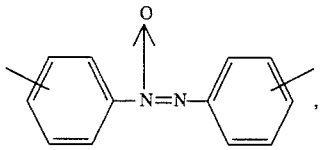
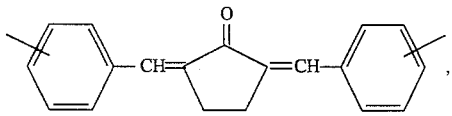
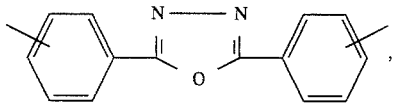
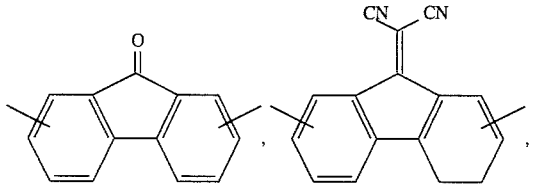
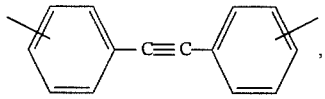
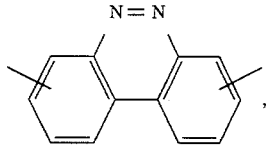
-continued
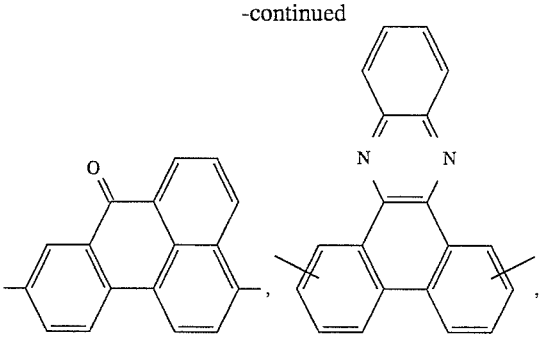
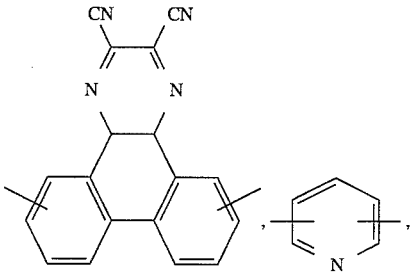
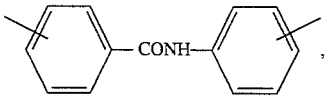
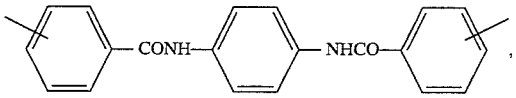
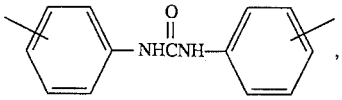
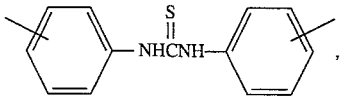
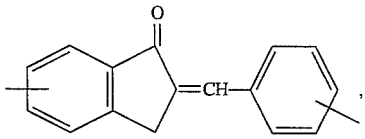
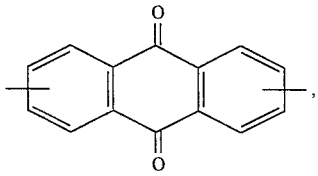
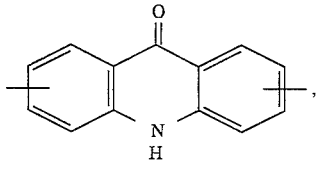

-continued

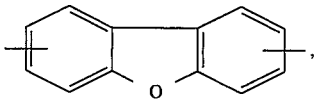

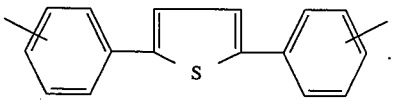

In the recurring units (1) and (2), specific examples of $R_1$, $R_2$, $R_8$ and $R_9$ may include: hydrogen atom: alkyl group such as methyl, ethyl or propyl; alkoxyalkyl group such as methoxyethyl; and aralkyl group such as benzyl. Each of $R_1$, $R_2$, $R_8$ and $R_9$ may have a substituent such as halogen atom.

Further, specific examples of $R_3$ to $R_7$ and $R_{10}$ in the recurring units (1) and (2) may include: hydrogen atom: halogen atom such as fluorine, chlorine or bromine: alkyl group such as methyl, ethyl or propyl; alkoxy group such as methoxy, ethoxy or propoxy; aryl group such as phenyl or naphthyl; nitro group: and cyano group. Each of $R_3$ to $R_7$ and $R_{10}$ may have a substituent such as halogen atom. In the present invention, all of $R_3$ to $R_7$ and $R_{10}$ may preferably be hydrogen.

In the recurring unit (2), specific examples of $R_{11}$ and $R_{12}$ may include alkyl group such as methyl or ethyl. Each of $R_{11}$ and $R_{12}$ may have a substituent such as halogen atom. In the present invention, $R_{11}$ and $R_{12}$ may preferably be methyl simultaneously.

The resin having the recurring unit (1) and/or the recurring unit (2) used in the present invention may preferably have a number-average molecular weight (Mn) of 500–100,000, more preferably 10,000–50,000.

In some cases of the present invention, the resin has a recurring unit containing imide structure (e.g.,

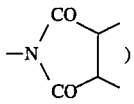

formed through a reaction in which amide portion of amide acid or amide acid ester in the recurring unit (1) or (2) is reacted with acid or acid ester portion to eliminate water or alcohol depending upon drying conditions in an ordinary drying step of a production process of an electrophotographic photosensitive member.

The resin used in the present invention may preferably contain acid structure and/or acid ester structure (i.e., —$COOR_1$, —$COOR_2$, —$COOR_8$, —$COOR_9$) in a proportion of 20–80 mole %, particularly 40–60 mole %, per the total of the acid structure, the acid ester structure and imide structure (e.g.,

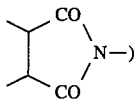

in the entire resin structure. This is presumably because the polyamide acid structure and/or the polyamide acid ester structure is effective in suppressing injection of hole from an electroconductive support and promoting electrolytic dissociation of a carrier generated by the action of a charge-generating material and injection of electron into an intermediate layer. Further, we pressure that the polyimide structure has a densed and packed state, whereby the electrolytic dissociation of a carrier and injection and movement of electron is promoted and such a structure is little affected by moisture.

Hereinbelow, specific and non-exhaustive examples of the recurring units (1) and (2) of the resin used in the present invention are shown by indicating varying parts $R_1$ to $R_{12}$, $A_1$ and $A_2$ with reference to the recurring units (1) and (2). However, the recurring units (1) and (2) adopted to the present invention are not limited thereto.

Formula (1):

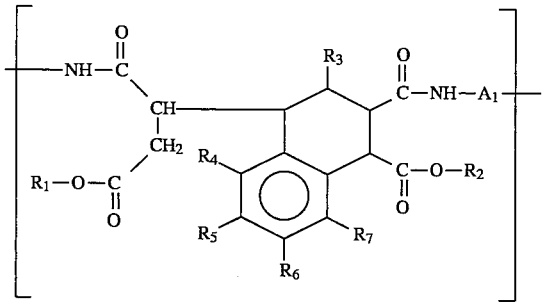

| Ex. Comp. No. | $R_1$ and $R_2$ | $R_3$ to $R_7$ | $A_1$ |
|---|---|---|---|
| 1-1 | $-CH_3$ | $-H$ | 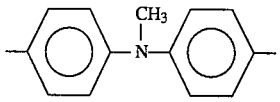 |
| 1-2 | $-CH_3$ | $-H$ | 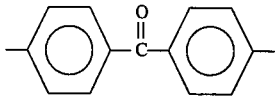 |

-continued
Formula (1):
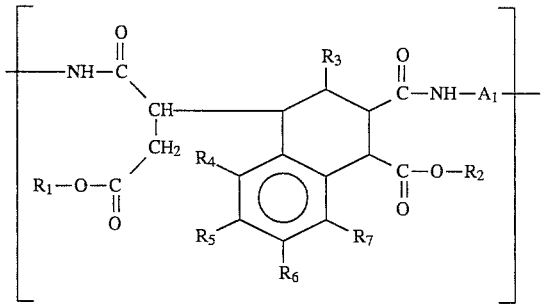
| Ex. Comp. No. | $R_1$ and $R_2$ | $R_3$ to $R_7$ | $A_1$ |
|---|---|---|---|
| 1-3 | $-CH_3$ | $-H$ | 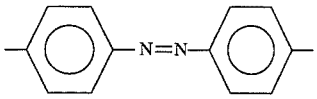 |
| 1-4 | $-CH_3$ | $-H$ | 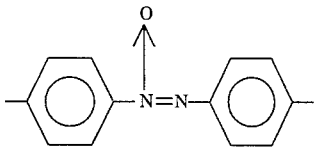 |
| 1-5 | $-C_2H_5$ | $-H$ | 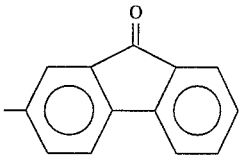 |
| 1-6 | $-C_2H_5$ | $-H$ | 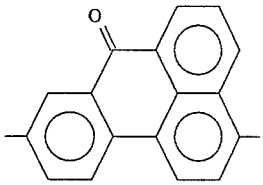 |
| 1-7 | $-CH_3$ | $-H$ | 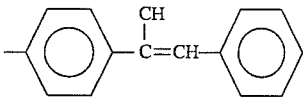 |
| 1-8 | $-C_2H_5$ | $-H$ | 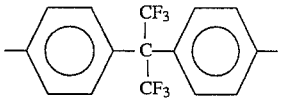 |
| 1-9 | 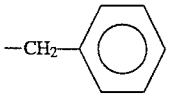 | $-H$ | 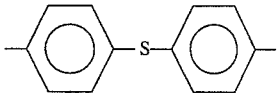 |
| 1-10 | $-C_3H_7$ | $-H$ | 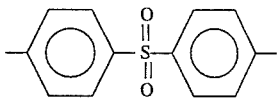 |

-continued
Formula (1):
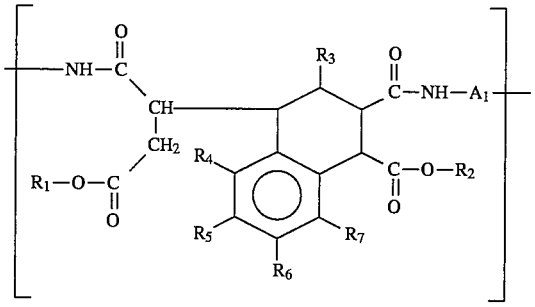
| Ex. Comp. No. | $R_1$ and $R_2$ | $R_3$ to $R_7$ | $A_1$ |
|---|---|---|---|
| 1-11 | 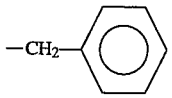 | —H | 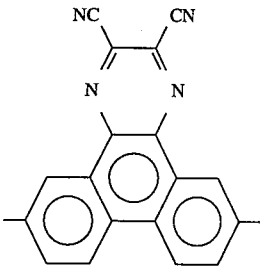 |
| 1-12 | —$CH_3$ | —H | 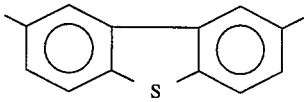 |
| 1-13 | —$CH_3$ | —H | 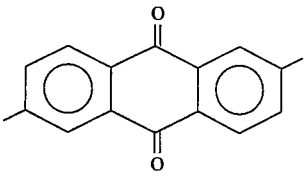 |
| 1-14 | —$CH_3$ | —H | 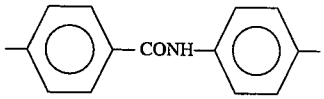 |
| 1-15 | —$C_2H_5$ | —H | 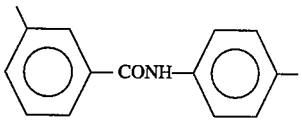 |
| 1-16 | —$C_3H_7$ | —H | 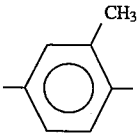 |
| 1-17 | —$CH_3$ | —H | 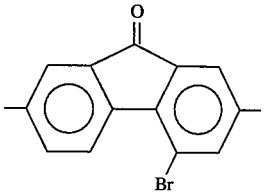 |

-continued
Formula (1):
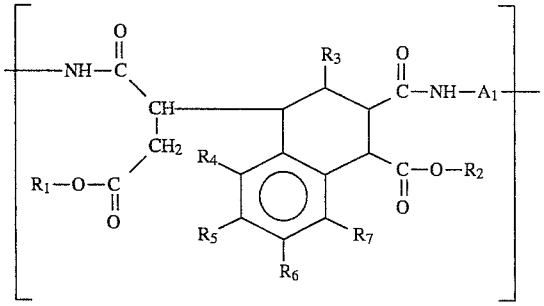
| Ex. Comp. No. | $R_1$ and $R_2$ | $R_3$ to $R_7$ | $A_1$ |
|---|---|---|---|
| 1-18 | $-CH_3$ | $-H$ | 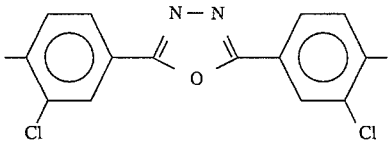 |
| 1-19 | $-CH_3$ | $-H$ | 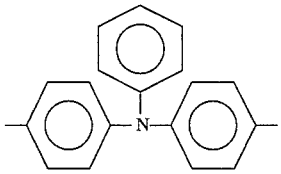 |
| 1-20 | $-CH_3$ | $-H$ | 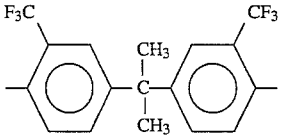 |
| 1-21 | $-CH_3$ | $-H$ | 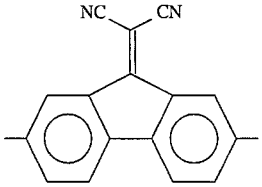 |
| 1-22 | $-CH_3$ | $-H$ | $\leftarrow CH_2 \rightarrow_6$ |
| 1-23 | $-CH_3$ | $-H$ | $\leftarrow CH_2 \rightarrow_8$ |
| 1-24 | $-H$ | $R_3, R_5, R_6, R_7$: $-H$<br>$R_4$: $-CH_3$ | 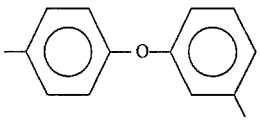 |
| 1-25 | $-H$ | $R_3$ to $R_6$: $-H$<br>$R_7$: $-OCH_3$ | 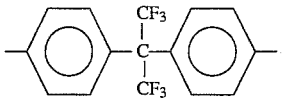 |
| 1-26 | $-H$ | $R_3, R_4, R_5, R_7$: $-H$<br>$R_6$: $-OCH_2CF_3$ | 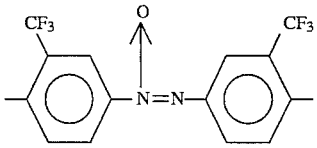 |

-continued
Formula (1):
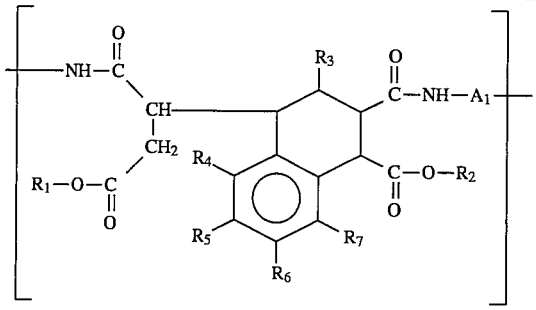
| Ex. Comp. No. | $R_1$ and $R_2$ | $R_3$ to $R_7$ | $A_1$ |
|---|---|---|---|
| 1-27 | —H | $R_3$, $R_4$, $R_5$, $R_7$: —H<br>$R_6$: —Cl | 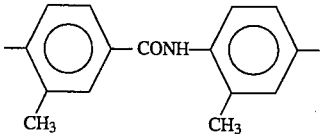 |
| 1-28 | —H | $R_3$: $-CH_3$<br>$R_4$ to $R_7$: —H | 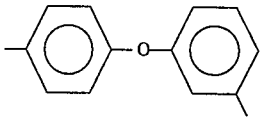 |
| 1-29 | 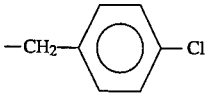 | $R_3$, $R_4$, $R_5$, $R_7$: —H<br>$R_6$: $-CH_2CH_3$ | 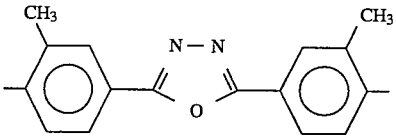 |
| 1-30 | $-CH_2OCH_3$ | $R_3$: $-CH_3$<br>$R_4$, $R_6$, $R_7$: —H<br>$R_5$: 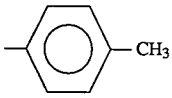 | $\leftarrow CH_2 \rightarrow_8$ |
| 1-31 | $-CH_2CF_3$ | $R_3$: $-CH_3$<br>$R_4$, $R_7$: —H<br>$R_5$: 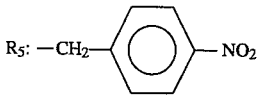 <br>$R_6$: $-NO_2$ | 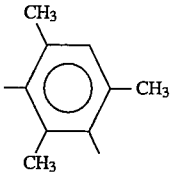 |
| 1-32 | —H | $R_3$: $-CH_2F$<br>$R_4$, $R_5$, $R_7$: —H<br>$R_6$: —CN | 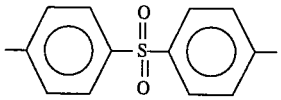 |

Formula (2):
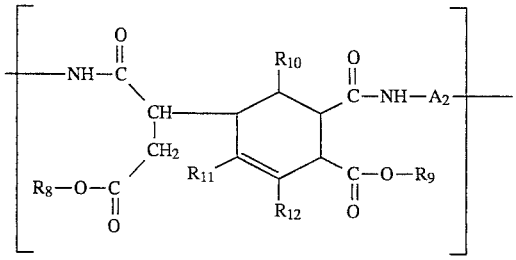
| Ex. Comp. No. | $R_8$ and $R_9$ | $R_{10}$ | $R_{11}$ and $R_{12}$ | $A_2$ |
|---|---|---|---|---|
| 2-1 | —H | —H | $-CH_3$ | 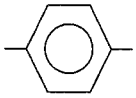 |
| 2-2 | —H | —H | $-CH_3$ | 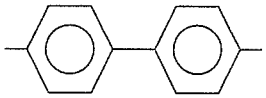 |
| 2-3 | —H | —H | $-CH_3$ | 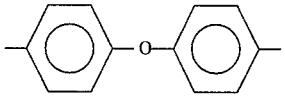 |
| 2-4 | —H | —H | $-CH_3$ | 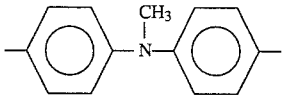 |
| 2-5 | —H | —H | $-CH_3$ | 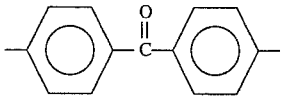 |
| 2-6 | —H | —H | $-CH_3$ | 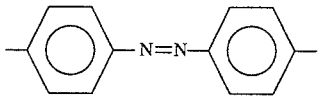 |
| 2-7 | —H | —H | $-CH_3$ | 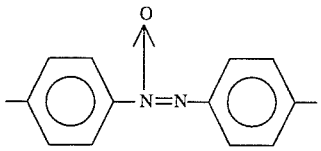 |
| 2-8 | —H | —H | $-CH_3$ | 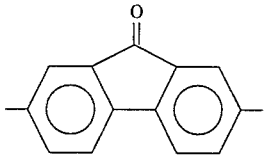 |
| 2-9 | —H | —H | $-CH_3$ | 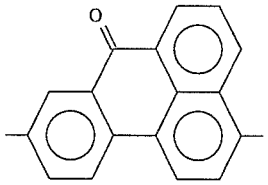 |
| 2-10 | —H | —H | $-CH_3$ | 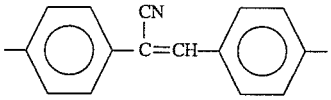 |

-continued
Formula (2):
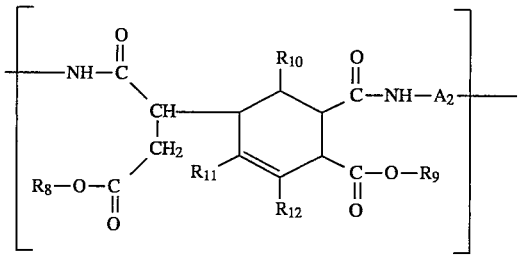
| Ex. Comp. No. | $R_8$ and $R_9$ | $R_{10}$ | $R_{11}$ and $R_{12}$ | $A_2$ |
|---|---|---|---|---|
| 2-11 | —H | —H | $-CH_3$ | 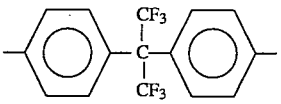 |
| 2-12 | —H | —H | $-CH_3$ | 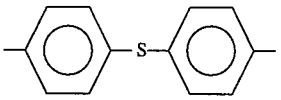 |
| 2-13 | —H | —H | $-CH_3$ | 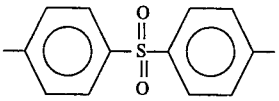 |
| 2-14 | —H | —H | $-CH_3$ | 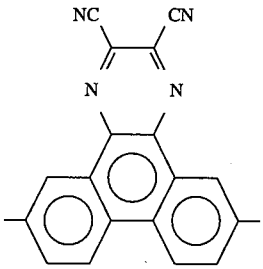 |
| 2-15 | —H | —H | $-CH_3$ | 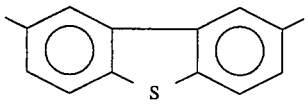 |
| 2-16 | —H | —H | $-CH_3$ | 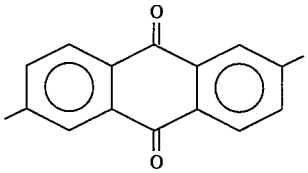 |
| 2-17 | —H | —H | $-CH_3$ | 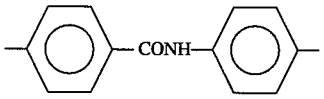 |
| 2-18 | —H | —H | $-CH_3$ | 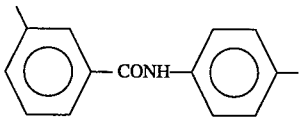 |
| 2-19 | —H | —H | $-CH_3$ | 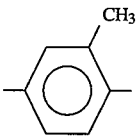 |

-continued
Formula (2):
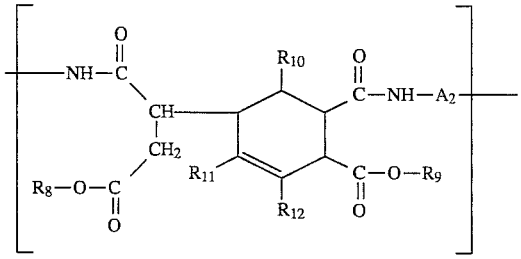
| Ex. Comp. No. | $R_8$ and $R_9$ | $R_{10}$ | $R_{11}$ and $R_{12}$ | $A_2$ |
|---|---|---|---|---|
| 2-20 | —H | —H | —$CH_2$ | 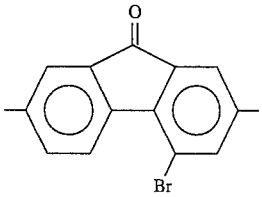 |
| 2-21 | —H | —H | —$CH_3$ | 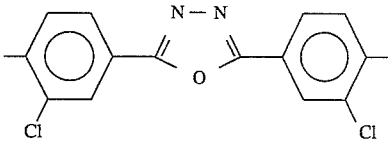 |
| 2-22 | —H | —H | —$CH_3$ | 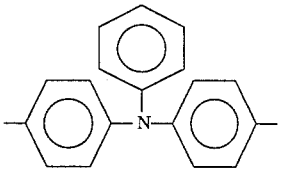 |
| 2-23 | —H | —H | —$CH_3$ | 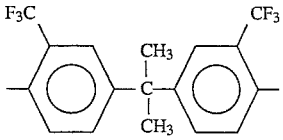 |
| 2-24 | —H | —H | —$CH_3$ | 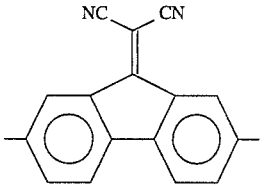 |
| 2-25 | —H | —H | —$CH_3$ | $\leftarrow CH_2 \rightarrow_6$ |
| 2-26 | —H | —H | —$CH_3$ | $\leftarrow CH_2 \rightarrow_8$ |
| 2-27 | —$CH_3$ | —H | —$CH_3$ | 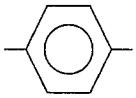 |
| 2-28 | —$CH_3$ | —H | —$CH_3$ | 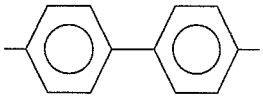 |
| 2-29 | —$CH_3$ | —H | —$CH_3$ | 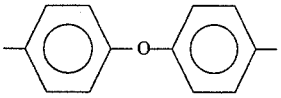 |

-continued
Formula (2):
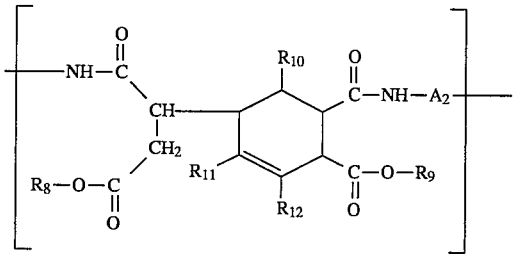
| Ex. Comp. No. | $R_8$ and $R_9$ | $R_{10}$ | $R_{11}$ and $R_{12}$ | $A_2$ |
|---|---|---|---|---|
| 2-30 | —H | —$CH_3$ | —$CH_3$ | 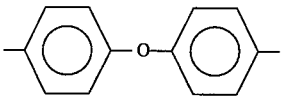 |
| 2-31 | —H | —H | —$CH_3$ | 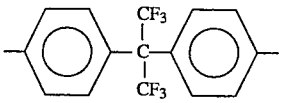 |
| 2-32 | —H | —$CH_3$ | —$CH_2CH_3$ | 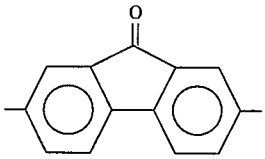 |
| 2-33 | —H | —CN | —$CH_3$ | 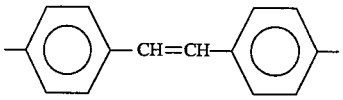 |
| 2-34 | —H | —$OCH_2Cl$ | —$CH_2CH_3$ | 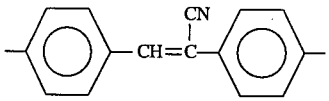 |
| 2-35 | 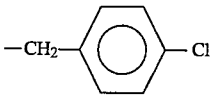 | —Cl | —$CH_2CH_3$ | 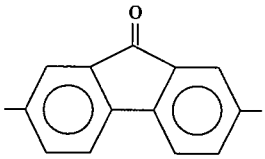 |
| 2-36 | —$CH_2OCF_3$ | 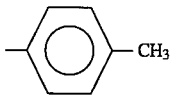 | —$CH_3$ | 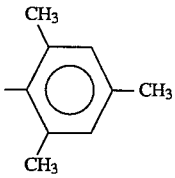 |
| 2-37 | —$CH_2OCH_3$ | —$OCH_3$ | —$CH_3$ | 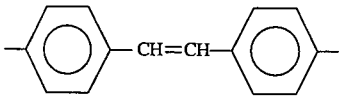 |
| 2-38 | —H | —$NO_2$ | —$CH_2CH_3$ | 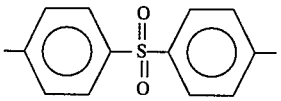 |

The resin having amide acid structure (e.g.,

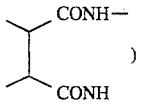

constituting the recurring unit (1) and/or the recurring unit (2) used in the present invention may generally be synthesized through ring-opening polyaddition reaction in which a tetracarboxylic dianhydride is reacted with a diamine in an organic polar solvent. Examples of such an organic polar solvent may include: amide-type solvent such as N,N-dimethylacetoamide, N-N-dimethylformamide or N-methylpyrrolidone; phenol-type solvent such as cresol or chlorophenol; ether-type solvent such as diethylene glycol dimethyl ether; and a mixture solvent thereof. It is also possible to effect the reaction by adding an appropriate amount (at most 5 wt. %) of water to the organic polar solvent as mentioned above in order to control a molecular weight of a resultant resin. The reaction temperature in the above reaction may preferably be 20°–120° C., particularly 20°–40° C.

Then, the resin having amide acid ester structure (e.g.,

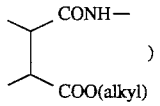

(constituting the recurring unit (1) and/or (2)) may be synthesized through esterification between the above-prepared polyamide acid and an appropriate alcohol in the presence of an appropriate catalyst. Examples of such a catalyst may include mineral acid such as sulfuric acid or hydrochloric acid; and organic acid such as p-toluenesulfonic acid. It is also possible to synthesize the resin having amide ester structure by esterifying two carboxyl groups in four carboxyl groups of tetracarboxylic acid (i.e., half esterification) and then reacting the half ester with a diamine.

The resin (partially) having the imide structure (e.g.,

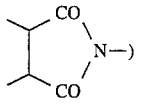

described above may be formed by heat-treating the polyamide acid or the polyamide acid ester at an appropriate temperature, preferably at 50°–400° C., for a prescribed time, preferably for 5 minutes to 4 hours. The treating temperature and treating time largely affect a ratio (mole %) of the imide structure to the total of the imide structure and the acid structure and/or acid ester structure (i.e., —$COOR_1$, —$COOR_2$, —$COOR_8$, —$COOR_9$) in the entire resin structure (herein, referred to as "imide degree").

The imide degree can be determined based on a ratio of an absorbance at 1500 $cm^{-1}$ with respect to phenylene group to an absorbance at 1740–1780 $cm^{-1}$ with respect to imido group obtained by using infrared absorption spectrum measurement (or infrared (absorption) spectrophotometry) of a sample resin or based on an amount of proton present in carboxyl group and carboxyl ester (or carboxylate) group of a sample resin obtained by using $H^1$-NMR (nuclear magnetic resonance) spectrum.

The above-mentioned production (or treating) process of the resin used in the present invention is shown as follows.

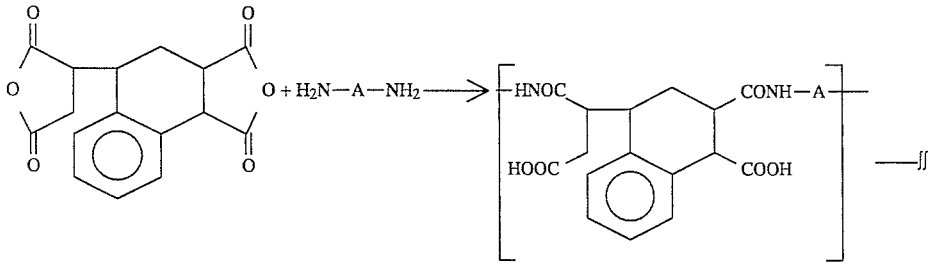

-continued

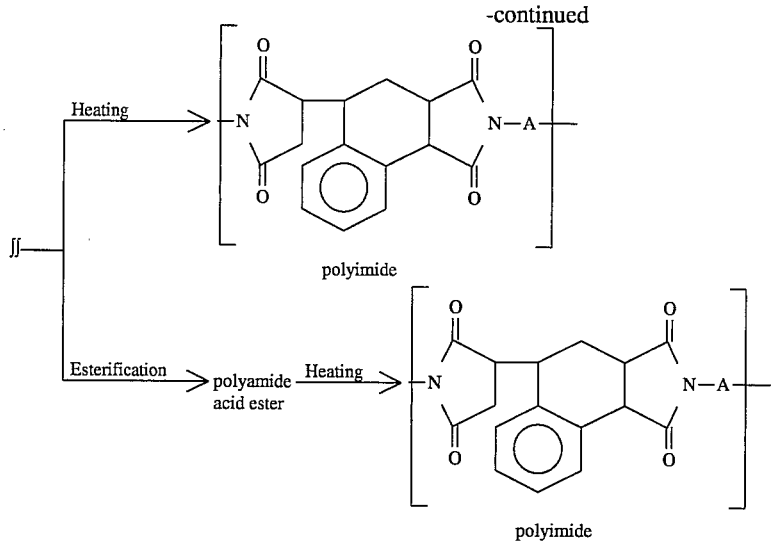

Synthesis Example

In a 500 ml-four necked flask, 13.9 g (0.05M) of a compound having the following formula:

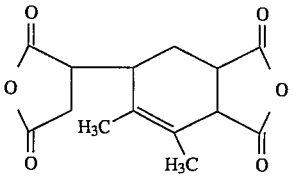

and 160 g of N,N-dimethylacetoamide were placed while supplying therein dry nitrogen gas. Then, the solution was vigorously stirred at 25° C., followed by addition of 10.0 g (0.05M) of 4,4'-diaminodiphenyl ether in 1–2 minutes. The mixture was further stirred for 2 hours while continuously supplying dry nitrogen gas, whereby a viscous pale yellow liquid (reaction mixture) was obtained. To the reaction mixture, 160 g of N,N-dimethylacetoamide was added thereby to form a uniform solution. The uniform solution was added dropwise to 5 liters of methanol under vigorous stirring to precipitate a polyamide acid. The polyamide acid was recovered by filtration and dissolved in 250 g of N,N-dimethylacetoamide, followed by filtration to remove an insoluble matter. The filtrate was added dropwise to 5 liters of methanol to precipitate a polymer. The polymer was recovered by filtration and dispersed in and washed with 2 liters of methanol, followed by drying to obtain 15.3 g of a polyamide acid resin having a recurring unit 2–3.

Then, a solution of 1 g of the polyamide acid resin in 19 g of N,N-dimethylacetoamide was applied onto a KBr plate by wire bar coating, followed by drying at 140° C. for 30 minutes to form a sample having a 1 μm-thick layer. The sample was subjected to measurement of infrared absorption spectrum by using an infrared spectrophotometer ("FTIR 1600 series", available from Perkinelmer Co.), whereby a peak at around 1755 $cm^{-1}$ with respect to imide ring was confirmed, thus identifying the formation of the imide (ring) structure. The resin showed an imide degree of 55 mole %.

Other resins usable in the present invention can be prepared in the same manner as in the above case.

The intermediate layer used in the present invention may be composed of a single layer or a plurality of layers in which at least one layer thereof containing the resin having the recurring unit (1) and/or (2) described above. In case where the intermediate layer is composed of the plurality of layers, each of the layers may contain another resin different from the resin having the recurring unit (1) and/or (2). Examples of such another resin may include polyamide, polyester and phenolic resin.

The intermediate layer may contain another resin as described above, an additive and an electroconductive substance, as desired, in an amount capable of achieving the effect of the present invention. Examples of the additive may include an acceptor such as 2,5,7-trinitrofluorenone or benzoquinone. Examples of the electroconductive substance may include: metal powder (e.g., those of aluminum, copper, nickel and silver); metallic short fiber; carbon fiber; and electroconductive powder such as carbon black, titanium black, graphite, metal oxide and metal sulfide (e.g., antimony oxide, indium oxide, tin oxide, titanium oxide, zinc oxide, potassium titanate, barium titanate, magnesium titanate, zinc sulfide, copper sulfide, magnesium oxide and aluminum oxide), these metal oxides and metal sulfides surface-treated with an electroconductive material, silane coupling agent or titanium coupling agent, and these metal oxides and metal sulfide which have been subjected to reduction treatment.

In the present invention, the intermediate layer may preferably contain an electroconductive substance as described above. The intermediate layer may also preferably comprise a first layer containing an electroconductive substance as described above and a second layer containing no electroconductive substance.

The intermediate layer may be formed by dispersing or dissolving the resin having the recurring unit (1) and/or (2) in an appropriate solvent, applying the resultant coating liquid onto the electroconductive support by using a known coating method and then drying the coating.

The intermediate layer used in the present invention may preferably contain the resin having the recurring unit (1) and/or the recurring unit (2) in a proportion of 10–90 wt. %, particularly 30–70 wt. %, per the entire weight of the intermediate layer. The intermediate layer may have an appropriate thickness in view of electrophotographic properties and defects on the electroconductive support but may preferably have a thickness of 0.1–50 μm, particularly 0.5–30 μm.

The photosensitive layer used in the present invention is formed on the intermediate layer disposed on the electroconductive support. The photosensitive layer may be roughly classified into a single layer-type photosensitive layer wherein a charge-generating material and a charge-transporting material are contained in a single layer and a lamination layer-type photosensitive layer comprising a charge generation layer containing a charge-generating material and a charge transport layer containing a charge-transporting material. The lamination layer-type photosensitive layer may further be classified into one comprising a charge generation layer and a charge transport layer in this order (or in sequence) disposed on the electroconductive support and one comprising a charge transport layer and a charge generation layer in this order disposed on the electroconductive support. In the present invention, the electrophotographic photosensitive member may preferably be constituted by disposing an electroconductive support, an intermediate layer, a charge generation layer and a charge transport layer in this order.

Examples of the charge-generating material constituting the charge generation layer may include: azo pigments of monoazo-type, bisazo-type, trisazo-type, etc.; phthalocyanine pigments such as metallophthalocyanine and non-metallophthalocyanine; indigo pigments such as indigo and thioindigo; polycyclic quinone pigments such as anthraquinone and pyrenequinone; perylene pigments such as perylenic anhydride and perylenimide; squalium colorants; pyrilium salts and thiopyrilium salts; and triphenylmethane colorants.

In the present invention, the charge generation layer may be formed by dispersing the charge-generating material in an appropriate solution containing a binder resin and a solvent, applying the resultant coating liquid onto, e.g., the intermediate layer by using a known coating method and then drying the coating. The charge generation layer may preferably have a thickness of at most 5 μm, particularly 0.05–2 μm. Examples of the binder resin may include polyvinyl acetal, polystyrene, polyester, polyvinyl acetate, methacrylic resin, acrylic resin, polyvinyl pyrolidone and cellulosic resin.

The charge transport layer according to the present invention may generally be formed by dissolving the charge-transporting material in an appropriate solvent together with a binder resin, applying the resultant coating liquid such as solution onto a predetermined surface (e.g., the surface of the intermediate layer, charge generation layer, etc.) by coating, and then drying the resultant coating.

The charge-transporting material may generally be classified roughly into an electron-transporting material and a hole-transporting material.

Examples of the electron-transporting material may include: an electron acceptor such as 2,4,7-trinitrofluorenone, 2,4,5,7-tetranitrofluorenone, chloranil or tetracyanoquinone-dimethane; and polymerized these substances. Examples of the hole-transporting material may include: polycyclic aromatic compounds such as pyrene and anthracene; heterocyclic compounds such as carbazoles, indoles, imidazole, oxazoles, thiazoles, oxadiazoles, pyrazoles, pyrazolines, thiadiazoles and triazole; hydrazone compounds such as p-diethylamionobenzaldehyde-N,N-diphenylhydrazone and N,N-diphenylhydrazino-3-methylidene-9-ethylcarbazole; styryl-type compounds such as α-phenyl-4'-N,N-diphenylaminostilbene and 5-[4-(di-p-tolylamino)-benzylidene]-5H-dibenzo-[a,d]-cycloheptene; benzidines; triarylamines; triphenylamine; and polymers having a group containing a group derived from the above-mentioned compounds at a main chain or a side chain, such as poly-N-vinylcarbazole and polyvinylanthracene.

Examples of the binder resin used for forming the charge transport layer may include polyester, polycarbonate, polymethacrylate and polystyrene. The charge transport layer may preferably have a thickness of 5–40 μm, particularly 10–30 μm.

In case where the photosensitive layer is composed of a single layer, the photosensitive layer may be formed by dispersing and dissolving the charge-generating material and the charge-transporting material respectively as described above in an appropriate solvent together with the binder resin as described above, applying the resultant coating liquid onto the intermediate layer by coating and then drying the coating.

The thickness of the single layer-type photosensitive layer may preferably be 5–40 microns, more preferably 10–30 microns.

The photosensitive layer used in the present invention may also include an organic photoconductive polymer layer comprising polyvinylcarbazole or polyvinylanthracene; a vapor-deposited layer of the above-mentioned charge-generating material; selenium vapor-deposited layer; selenium-tellurium vapor-deposited layer; and amorphous silicon layer.

The electroconductive support used in the present invention may include aluminum, aluminum alloy, copper, zinc, stainless steel, titanium, nickel, indium, gold and platinum. The electroconductive support may also include: a plastic (such as polyethylene, polypropyrene, polyvinyl chloride, polyethylene terephthalate or acrylic resins) coated with, e.g., a vacuum vapor-deposited layer of the above-mentioned metal or alloy; a plastic, metal or alloy coated with a layer comprising a mixture of an electroconductive powder (such as carbon black or silver particles) and an appropriate binder resin; and a plastic or paper impregnated with electroconductive particles. The electroconductive support may be in any form such as drum, sheet, film, belt, etc., and may preferably have a shape suitably adapted to an electrophotographic photosensitive member used.

In the present invention, in order to protect the photosensitive layer from external mechanical shock or external chemical action, a protective layer can further be disposed on the photosensitive layer. Such a protective layer may comprise a resin, or a resin containing electro-conductive particles.

In the present invention, examples of the coating method used for forming the respective layers (intermediate layer, photosensitive layer, protective layer) may include: dip coating, spray coating, beam coating, spin coating, roller coating, wire bar coating and blade coating.

The electrophotographic photosensitive member according to the present invention can be applied to not only an ordinary electrophotographic apparatus such as copying machine, a laser beam printer, a light-emitting diode (LED) printer, a liquid crystal shutter-type printer, but also other fields of applied electrophotography including, e.g., display, recording, light printing, plate making, and a facsimile machine.

FIG. 1 shows a schematic structural view of an electrophotographic apparatus including a process cartridge using an electrophotographic photosensitive member of the invention. Referring to FIG. 1, a photosensitive drum (i.e., photosensitive member) 1 as an image-carrying member is rotated about an axis 2 at a prescribed peripheral speed in the direction of the arrow shown inside of the photosensitive drum 1. The surface of the photosensitive drum is uniformly charged by means of a primary charger (charging means) 3 to have a prescribed positive or negative potential. The photosensitive drum 1 is exposed to light-image 4 (as by slit exposure or laser beam-scanning exposure) by using an image-exposure means (not shown), whereby an electrostatic latent image corresponding to an exposure image is successively formed on the surface of the photosensitive drum 1. The electrostatic latent image is developed by a developing means 5 to form a toner image. The toner image is successively transferred to a transfer material 7 which is supplied from a supply part (not shown) to a position between the photosensitive drum 1 and a transfer charger (transfer means) 6 in synchronism with the rotating speed of the photosensitive drum 1, by means of the transfer charger 6. The transfer material 7 with the toner image thereon is separated from the photosensitive drum 1 to be conveyed to a fixing device (image-fixing means) 8, followed by image fixing to print out the transfer material 7 as a copy product outside the electrophotographic apparatus. Residual toner particles on the surface of the photosensitive drum 1 after the transfer are removed by means of a cleaner (cleaning means) 9 to provide a cleaned surface, and residual charge on the surface of the photosensitive drum 1 is erased by a pre-exposure light 10 emitted from a pre-exposure means (not shown) to prepare for the next cycle. In case where the primary charging means 3 is a contact charging means such as a charging roller, the pre-exposure step may be omitted.

According to the present invention, in the electrophotographic apparatus, it is possible to provide a process cartridge 11 which includes plural means inclusive of or selected from the photosensitive member (photosensitive drum) 1, the charging means 3, the developing means 5, the cleaning means 9, etc. so as to be attached (or connected) to or detached (or released) from an apparatus body of the electrophotographic apparatus such as a copying machine or a laser beam printer, as desired. The process cartridge 11 may, for example, be composed of the photosensitive member and at least one device of the charging means 3, the developing means 5 and the cleaning means 9 which are integrally supported to prepare a single unit capable of being connected to or released from the body of the electrophotographic apparatus by using a guiding means such as a rail 12 in the body.

In case where the electrophotographic apparatus is used as a copying machine or a printer, image-exposure light 4 may be given by reading data on reflection light or transmitted light from an original or by reading data on the original by a sensor, converting the data into a signal and then effecting a laser beam scanning, a drive of LED array or a drive of a liquid crystal shutter array so as to expose the photosensitive member to the light-image 4.

Figure 2:
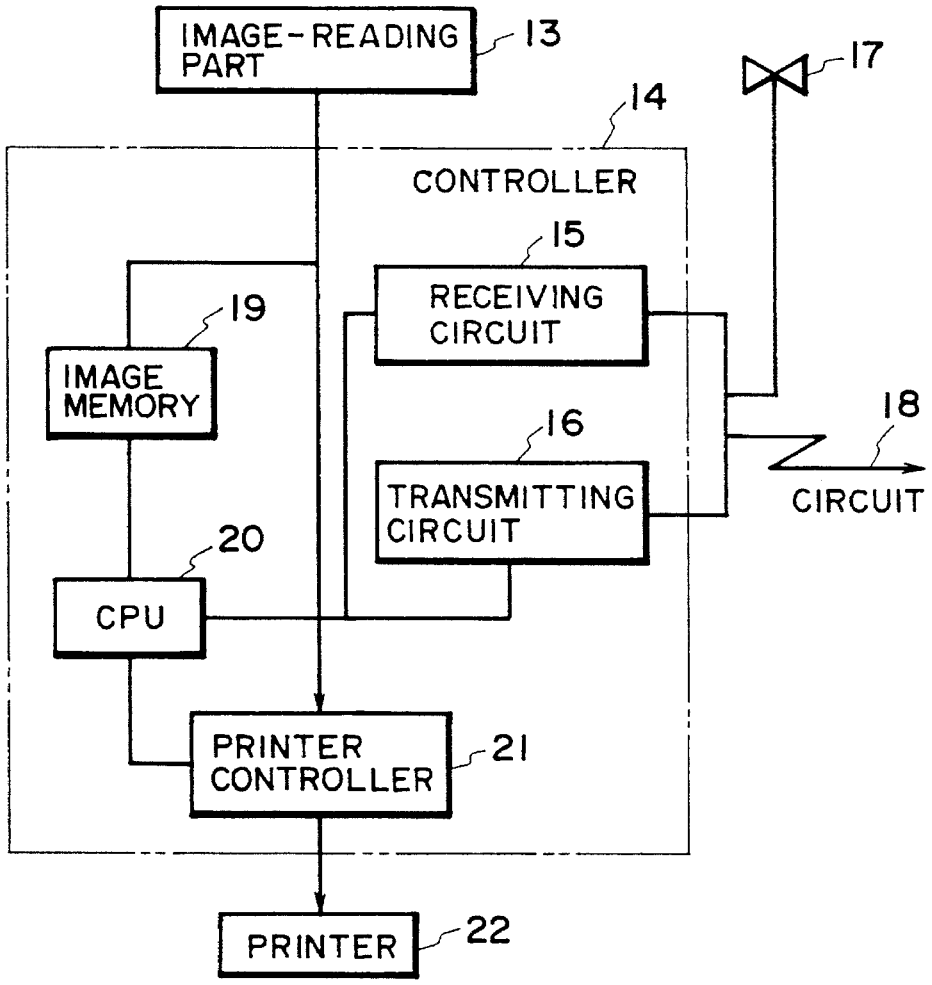
FIG. 2 is a block diagram of a facsimile machine using an electrophotographic apparatus according to the present invention as a printer.

In case where the electrophotographic apparatus according to the present invention is used as a printer of a facsimile machine, image-exposure light 4 is given by exposure for printing received data. FIG. 2 shows a block diagram of an embodiment for explaining this case. Referring to FIG. 2, a controller 14 controls an image-reading part 13 and a printer 22. The whole controller 14 is controlled by a CPU (central processing unit) 20. Read data from the image-reading part 13 is transmitted to a partner station through a transmitting circuit 16, and on the other hand, the received data from the partner station is sent to the printer 22 through a receiving circuit 15. An image memory memorizes prescribed image data. A printer controller 21 controls the printer 22, and a reference numeral 17 denotes a telephone handset.

The image received through a circuit 18 (the image data sent through the circuit from a connected remote terminal) is demodulated by means of the receiving circuit 15 and successively stored in an image memory 19 after a restoring-signal processing of the image data. When image for at least one page is stored in the image memory 19, image recording of the page is effected. The CPU 20 reads out the image data for one page from the image memory 19 and sends the image data for one page subjected to the restoring-signal processing to the printer controller 21. The printer controller 21 receives the image data for one page from the CPU 20 and controls the printer 22 in order to effect image-data recording. Further, the CPU 20 is caused to receive image for a subsequent page during the recording by the printer 22. As described above, the receiving and recording of the image are performed.

Hereinbelow, the present invention will be explained more specifically with reference to examples, to which the present invention is however not restricted.

In the following examples, "part(s)" means "weight part(s)".

EXAMPLE 1

Onto an aluminum substrate, a solution of 5 parts of a resin having a recurring unit 1-1 (number-average molecular weight (Mn) of 9000) in 95 parts of N,N-dimethylacetoamide was applied by wire bar coating, followed by drying at 140° C. for 10 minutes to form a 1 μm-thick intermediate layer. Separately, a 1 μm-thick resin layer was prepared in the same manner as in the above intermediate layer and subjected to measurement of infrared (IR) absorption spectrum described above, whereby the resin was found to have an imide degree of 73 mole %.

Then, to 5 parts of a disazo pigment of the following formula:

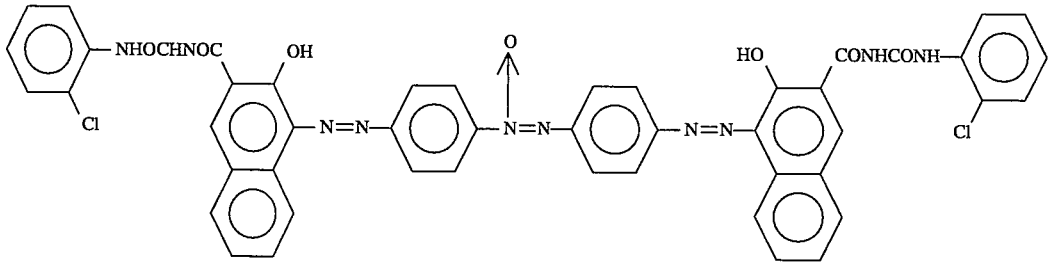

90 parts of tetrahydrofuran (THF) was added, followed by stirring for 20 hours in a sand mill. To the dispersion, a solution of 2.5 parts of butyral resin ("BLS", manufactured by Sekisui Kagaku Kogyo K.K.) in 20 parts of THF was added, followed by stirring for 2 hours. The resultant dispersion was diluted with 100 parts of cyclohexanone and 100 parts of THF to prepare a coating liquid. The coating liquid was applied onto the above-prepared intermediate layer by wire bar coating, followed by drying to form a 0.15 μm-thick charge generation layer.

Then, 5 parts of a triarylamine compound of the following formula:

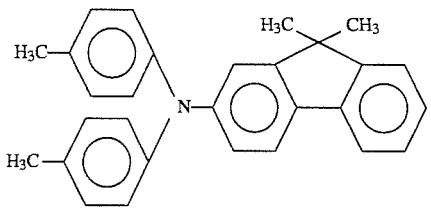

and 5 g of polycarbonate ("Z-200", mfd. by Mitsubishi Gas Kagaku K.K.) were dissolved in 40 g of chlorobenzene to prepare a coating liquid.

The coating liquid was applied onto the above-mentioned charge generation layer by means of a wire bar, followed by drying to form a 20 μm-thick charge transport layer, whereby an electrophotographic photosensitive member was prepared.

The thus prepared photosensitive member was negatively charged by using corona (−5 KV) according to a static method by means of an electrostatic copying paper tester (Model: SP-428, mfd. by Kawaguchi Denki K.K.) and retained in a dark place for 1 sec. Thereafter, the photosensitive member was exposed to halogen light for 0.1 sec. at an illuminance of 10 lux, to evaluate charging characteristics. More specifically, in order to evaluate the charging characteristics, the surface potential ($V_0$) at the time immediately after the charging, the exposure quantity ($E_{1/2}$) (i.e., sensitivity) required for decreasing the potential obtained after a dark decay of 1 sec to ½ thereof and the residual potential (Vr) (a potential at the time of 0.4 sec after the exposure) were measured.

The results are shown in Table 1 appearing hereinafter.

EXAMPLES 2–20

Photosensitive members were prepared and evaluated in the same manner as in Example 1 except that resins having a recurring unit (1) or (2) shown in Table 1 below were used instead of the resin having the recurring unit 1-1, respectively. The results are shown in Table 1.

Comparative Example 1

A photosensitive member was prepared and evaluated in the same manner as in Example 1 except that an intermediate layer was formed by using a solution of 5 parts of alcohol-soluble copolymer nylon ("Amilan CM-8000", mfd. by Toray K.K.) in 95 parts of methanol was used. The results are shown in Table 1.

Comparative Example 2

A photosensitive member was prepared and evaluated in the same manner as in Example 1 except that the drying condition for the intermediate layer in Example 1 was changed to "at 100° C. for 60 minutes" and an additional heat-treating step at 250° C. for 3 hours was performed. As a result of measurement of IR absorption spectrum, the resin for use in the intermediate layer was found to have an imide degree of 100% (i.e., the entire amide acid structural unit in the resin was all changed to the imide structural unit). The results are shown in Table 1 below.

TABLE 1

| | Recurring unit | $E_{1/2}$ (lux · sec) | Vr (−V) | Imide degree (mole %) |
|---|---|---|---|---|
| Ex. No. | | | | |
| Ex. 1 | 1-1 | 1.53 | 0 | 73 |
| Ex. 2 | 1-4 | 1.43 | 0 | 71 |
| Ex. 3 | 1-20 | 1.25 | 0 | 62 |
| Ex. 4 | 1-22 | 1.58 | 0 | 75 |
| Ex. 5 | 1-24 | 1.23 | 0 | 60 |
| Ex. 6 | 1-25 | 1.38 | 0 | 48 |
| Ex. 7 | 1-27 | 1.23 | 0 | 32 |
| Ex. 8 | 1-28 | 1.35 | 0 | 45 |
| Ex. 9 | 1-29 | 1.40 | 0 | 58 |
| Ex. 10 | 1-31 | 1.25 | 0 | 71 |
| Ex. 11 | 2-3 | 1.11 | 0 | 55 |
| Ex. 12 | 2-7 | 1.25 | 0 | 49 |
| Ex. 13 | 2-8 | 1.23 | 0 | 55 |
| Ex. 14 | 2-10 | 1.19 | 0 | 65 |
| Ex. 15 | 2-12 | 1.38 | 0 | 70 |
| Ex. 16 | 2-28 | 1.53 | 0 | 68 |
| Ex. 17 | 2-30 | 1.19 | 0 | 45 |
| Ex. 18 | 2-31 | 1.13 | 0 | 32 |
| Ex. 19 | 2-32 | 1.35 | 0 | 39 |
| Ex. 20 | 2-36 | 1.48 | 0 | 55 |
| Comp. Ex. | | | | |
| 1 | — | 1.58 | 0 | — |
| 2 | — | 2.35 | 25 | 100 |

EXAMPLE 21

A photosensitive member was prepared in the same manner as in Example 1 except that a step of forming an intermediate layer was performed under the following conditions:

Electroconductive support: aluminum cylinder (outer diameter=30 mm, length=360 mm)

Drying condition: at 140° C. for 30 minutes

Coating method: dip coating

Thickness: 2.0 μm (after drying)

The results are shown in Table 2 appearing hereinbelow.

The thus-prepared photosensitive member was installed in a plain paper copying machine, of normal development system, performing processes of charging-exposure-development-transfer-cleaning at a rate of 0.8 sec/cycle and was then subjected to image formation of 10,000 sheets (durability test) under low-temperature and low-humidity environmental condition (15° C., 15%RH) to evaluate electrophotographic characteristics. More specifically, in order to evaluate the electrophotographic characteristics, a dark-part potential ($V_D$) at an initial stage and light-part potential ($V_L$) at the initial stage and after the durability test (after copying of 10,000 sheets) were measured and a resultant image was subjected to eye observation. Separately, an intermediate layer was formed on an aluminum plate (size: 100 mm×100 mm×1 mm) in the same manner as described above to prepare a sample plate and subjected to the following peeling test.

On the above sample plate, 11 parallel and straight lines with a length of 20 mm are drawn at a spacing of 1 mm with a cutter (new one) while making the cutter keep a cutting angle (an angle formed between the cutting blade and the sample plate surface) of 30 degrees and cut into the aluminum plate having thereon the intermediate layer so as to be brought into slight contact with the aluminum plate surface. Similarly, other 11 parallel and straight lines are drawn so that they cut the above 11 lines at right angles, thus forming 100 pieces of square region (1 mm×1 mm) of the intermediate layer on the aluminum plate. Onto the thus-treated aluminum plate, a cellophane tape (available from Nichiban K.K.) is applied. Then, the cellophane tape is peeled from the aluminum plate to observe the peeling state, thus obtaining a ratio (%) of the number of the peeled pieces of the intermediate layer to 100 (pieces of the intermediate layer). This operation is repeated five times to determine a peeling ratio (available peeling ratio) (%) by averaging 5 measured values.

The results are shown shown in Table 2.

EXAMPLES 22–37

Photosensitive members were prepared and evaluated in the same manner as in Example 21 except that each of the coating liquids for the intermediate layers prepared in Examples 2–17 (corresponding to Examples 22–37, respectively) was used. The results are shown in Table 2.

Comparative Example 3

A photosensitive member was prepared and evaluated in the same manner as in Example 21 except that the coating liquid for the intermediate layer prepared in Comparative Example 1 was used. The results are shown in Table 2.

Comparative Example 4

A photosensitive member was prepared and evaluated in the same manner as in Example 21 except that an intermediate layer was formed by using a mixture solution of 14 parts of polyester polyol ("NIPPORAN 125", mfd. by Nippon Polyurethane Kogyo K.K.), 6 parts of 2,6-tolylene diisocyanate, 0.02 part of dibutyltin dilaurate and 80 parts of methyl ethyl ketone. The results are shown in Table 2.

Comparative Example 5

A photosensitive member was prepared and evaluated in the same manner as in Example 21 except that the coating liquid for the intermediate layer prepared in Comparative Example 2 was used. The results are shown in Table 2 below.

TABLE 2

| | Initial | | After durability test | | Peeling ratio |
|---|---|---|---|---|---|
| Ex. No. | $V_D$ (–V) | $V_L$ (–V) | $V_L$ (–V) | Image | (%) |
| Ex. | | | | | |
| 21 | 715 | 175 | 195 | Good | 0 |
| 22 | 685 | 170 | 170 | " | 0 |
| 23 | 695 | 160 | 160 | " | 0 |
| 24 | 695 | 155 | 165 | " | 0 |
| 25 | 695 | 160 | 150 | " | 0 |
| 26 | 690 | 165 | 150 | " | 0 |
| 27 | 690 | 160 | 155 | " | 0 |
| 28 | 690 | 165 | 165 | " | 0 |
| 29 | 705 | 170 | 165 | " | 0 |
| 30 | 700 | 160 | 150 | " | 0 |
| 31 | 680 | 150 | 155 | " | 0 |
| 32 | 685 | 160 | 155 | " | 0 |
| 33 | 680 | 160 | 160 | " | 0 |
| 34 | 680 | 155 | 155 | " | 0 |
| 35 | 680 | 165 | 165 | " | 0 |
| 36 | 710 | 175 | 180 | " | 0 |
| 37 | 705 | 155 | 145 | " | 0 |
| Comp. Ex. | | | | | |
| 3 | 665 | 210 | 325 | Fog occurrence | 25 |
| 4 | 670 | 220 | 360 | Fog occurrence | 29 |
| 5 | 715 | 190 | 220 | Fog occurrence | 0 |

EXAMPLE 38

A coating liquid for a first intermediate layer was prepared by dispersing a mixture of 25 parts of a resin having a recurring unit 1-1, 50 parts of electroconductive titanium oxide powder coated with tin oxide containing antimony oxide (content=10%) and 25 parts of N,N-dimethylacetoamide in a sand mill for 20 hours. The coating liquid was applied onto an aluminum substrate by wire bar coating, followed by drying at 140° C. for 1 hour to form a 13 μm-thick first intermediate layer.

Then, an intermediate layer (as a second intermediate layer), a charge generation layer and a charge transport layer were successively formed on the above-prepared first intermediate layer in the same manner as in Example 1 except that the thickness of the (second) intermediate layer was changed to 0.5 μm, whereby an electrophotographic photosensitive member was prepared.

The photosensitive member was evaluated in the same manner as in Example 1. The results are shown in Table 3 appearing hereinafter.

EXAMPLES 39–52

Photosensitive members were prepared and evaluated in the same manner as in Example 38 except that resins having a recurring unit (1) or (2) shown in Table 3 below were used instead of the resin having the recurring unit 1-1, respectively. The results are shown in Table 3.

Comparative Example 6

A photosensitive member was prepared and evaluated in the same manner as in Example 38 except that a first intermediate layer was formed by using a dispersion mixture of 25 parts of resol-type phenolic resin ("Pli-O-phen J-325", mfd. by Dainippon Ink and Chemicals, Inc.), 50 parts of electroconductive titanium oxide powder coated with tin oxide containing antimony oxide (content=10%), 25 parts of ethylene glycol monomethyl ether (methyl cellosolve) and 5 parts of methanol, and a second intermediate layer was formed by using a solution of 5 parts of alcohol-soluble copolymer nylon ("Amilan CM-8000", mfd. by Toray K.K.) in 95 parts of methanol.

The results are shown in Table 3.

Comparative Example 7

A photosensitive member was prepared and evaluated in the same manner as in Example 38 except that the drying condition for the first intermediate layer in Example 38 was changed to "at 250° C. for 20 hours" and that for the second intermediate layer was changed to "at 250° C. for 3 hours", respectively. As a result of measurement of IR absorption spectrum, the resins for use in the first intermediate layer and the second intermediate layer were found to have an imide degree of 100% (i.e., each of the entire amide acid structural units in the resins was all changed to the imide structural unit), respectively. The results are shown in Table 3 below.

TABLE 3

| Ex. No. | Recurring unit: First int. layer | Recurring unit: Second int. layer | $E_{1/2}$ (lux · sec) | Vr (−V) |
|---|---|---|---|---|
| Ex. | | | | |
| 38 | 1-1 | 1-1 | 1.23 | 0 |
| 39 | 1-4 | 1-4 | 1.32 | 0 |
| 40 | 1-20 | 1-20 | 1.18 | 0 |
| 41 | 1-22 | 1-22 | 1.09 | 0 |
| 42 | 1-24 | 1-25 | 1.13 | 0 |
| 43 | 1-24 | 2-30 | 1.35 | 0 |
| 44 | 1-24 | 2-31 | 1.32 | 0 |
| 45 | 2-3 | 2-3 | 1.11 | 0 |
| 46 | 2-7 | 2-7 | 1.32 | 0 |
| 47 | 2-8 | 2-8 | 1.15 | 0 |
| 48 | 2-10 | 2-10 | 1.15 | 0 |
| 49 | 2-12 | 2-12 | 1.20 | 0 |
| 50 | 2-28 | 2-28 | 1.15 | 0 |
| 51 | 2-3 | that of Comp. Ex. 6 | 1.32 | 0 |
| 52 | that of Comp. Ex. 6 | 2-3 | 1.29 | 0 |
| Comp. Ex. | | | | |
| 6 | — | — | 1.55 | 0 |
| 7 | (2-3) | (2-3) | 1.63 | 25 |

EXAMPLES 53–61

Photosensitive members were prepared in the same manner as in Examples 42–50 (respectively corresponding to Examples 53–61) except that: the aluminum substrate was changed to an aluminum cylinder (outer diameter=30 mm, length=360 mm) and the coating method was changed to dip coating.

Each of the thus-prepared photosensitive members was evaluated in the same manner as in Example 21 except for omitting the peeling test. The results are shown in Table 4 appearing hereinafter.

Comparative Examples 8 and 9

Photosensitive members were prepared in the same manner as in Comparative Examples 6 and 7 (respectively corresponding to Comparative Examples 8 and 9) except that: the aluminum substrate was changed to an aluminum cylinder (outer diameter=30 mm, length=360 mm) and the coating method was changed to dip coating.

Each of the thus-prepared photosensitive members was evaluated in the same manner as in Example 21 except for omitting the peeling test. The results are shown in Table 4 below.

TABLE 4

| Ex. No. | Initial: $V_D$ (−V) | Initial: $V_L$ (−V) | After durability test: $V_L$ (−V) | After durability test: Image |
|---|---|---|---|---|
| Ex. | | | | |
| 53 | 705 | 150 | 155 | Good |
| 54 | 700 | 165 | 165 | Good |
| 55 | 700 | 160 | 170 | Good |
| 56 | 705 | 145 | 160 | Good |
| 57 | 710 | 155 | 160 | Good |

TABLE 4-continued

| Ex. No. | Initial: $V_D$ (−V) | Initial: $V_L$ (−V) | After durability test: $V_L$ (−V) | After durability test: Image |
|---|---|---|---|---|
| 58 | 710 | 150 | 160 | Good |
| 59 | 710 | 145 | 145 | Good |
| 60 | 710 | 150 | 150 | Good |
| 61 | 680 | 145 | 160 | Good |
| Comp. Ex. | | | | |
| 8 | 720 | 170 | 205 | Fog occurred |
| 9 | 700 | 175 | 195 | Fog occurred |

EXAMPLES 62–70

Each of first intermediate layers and second intermediate layers were successively formed on an aluminum cylinder in the same manner as in Examples 42–50 (corresponding to Examples 62–70, respectively).

Then, 4 parts of an oxytitaniumphthalocyanine pigment was added to a solution of 2 parts of polyvinyl butyral ("BX-I", mfd. by Sekisui Kagaku Kogyo K.K.) in 34 parts of cyclohexanone, followed by stirring for 8 hours in a sand mill. To the mixture, 60 parts of THF was added to prepare a coating liquid for a charge generation layer. The coating liquid was applied onto the above-prepared second intermediate layer, followed by drying to form a 0.2 μm-thick charge generation layer.

Then, a charge transport layer was formed on the above charge generation layer in the same manner as in Example 21 to prepare an electrophotographic photosensitive member.

The thus-prepared photosensitive member was installed in a laser beam printer, of reversal development system, performing processes of charging-exposure-development-transfer-cleaning at a rate of 6 sec/cycle and was then subjected to image formation of 5,000 sheets (durability test) under high-temperature and high-humidity environmental condition (30° C., 85%RH) to evaluate electrophotographic characteristics. More specifically, in order to evaluate the electrophotographic characteristics, a dark-part potential ($V_D$) at an initial stage and light-part potential ($V_L$) at the initial stage and after the durability test (after copying of 5,000 sheets) were measured and a resultant image was subjected to eye observation.

The results are shown in Table 5 appearing hereinafter.

Comparative Examples 10 and 11

Photosensitive members were prepared and evaluated in the same manner as in Example 62 except that each of first intermediate layers and second intermediate layers were successively formed in the same manner as in Comparative Examples 8 and 9 (corresponding to Comparative Examples 10 and 11, respectively. The results are shown in Table 5 below.

TABLE 5

| Ex. No. | Initial $V_D$ (−V) | Initial $V_L$ (−V) | After durability test $V_L$ (−V) | After durability test Image |
|---|---|---|---|---|
| Ex. | | | | |
| 62 | 685 | 145 | 150 | Good |
| 63 | 680 | 160 | 160 | Good |
| 64 | 690 | 155 | 160 | Good |
| 65 | 700 | 150 | 160 | Good |
| 66 | 695 | 150 | 150 | Good |
| 67 | 690 | 150 | 160 | Good |
| 68 | 695 | 145 | 155 | Good |
| 69 | 680 | 150 | 150 | Good |
| 70 | 690 | 145 | 155 | Good |
| Comp. Ex. | | | | |
| 10 | 680 | 190 | 380 | Black spots occurred |
| 11 | 710 | 210 | 250 | Black spots occurred |

What is claimed is:

1. An electrophotographic photosensitive member, comprising: an electroconductive support, an intermediate layer disposed on the electroconductive support and a photosensitive layer disposed on the intermediate layer, wherein the intermediate layer comprises a resin having at least one of a recurring unit (1) below and a recurring unit (2) below:

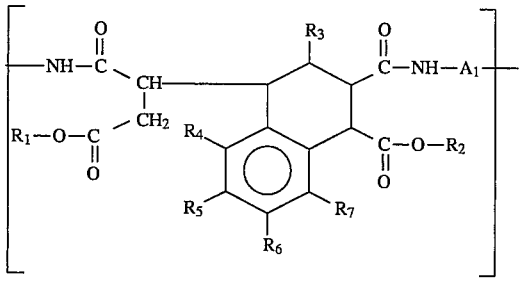

(1)

wherein $A_1$ is a divalent organic group; $R_1$ and $R_2$ independently denote hydrogen atom, substituted or unsubstituted alkyl group, substituted or unsubstituted alkoxyalkyl group, or substituted or unsubstituted aralkyl group; and $R_3$ to $R_7$ independently is hydrogen atom, halogen atom, substituted or unsubstituted alkyl group, substituted or unsubstituted alkoxy group, substituted or unsubstituted aryl group, nitro group, or cyano group; and

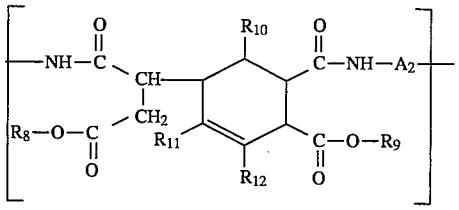

(2)

wherein $A_2$ denotes a divalent organic group; $R_8$ and $R_9$ independently is hydrogen atom, substituted or unsubstituted alkyl group, substituted or unsubstituted alkoxyalkyl group, or substituted or unsubstituted aralkyl group; $R_{10}$ is hydrogen atom, halogen atom, substituted or unsubstituted alkyl group, substituted or unsubstituted alkoxy group, substituted or unsubstituted aryl group, nitro group, or cyano group; and $R_{11}$ and $R_{12}$ independently denote alkyl group.

2. A member according to claim 1, wherein $R_3$ to $R_7$ and $R_{10}$ are hydrogen atom.

3. A member according to claim 1 or 2, wherein $R_{11}$ and $R_{12}$ are methyl group.

4. A member according to claim 1, wherein said resin has a recurring unit (1).

5. A member according to claim 4, wherein $R_3$ to $R_7$ are hydrogen atom.

6. A member according to claim 1, wherein said resin has a recurring unit (2).

7. A member according to claim 6, wherein $R_{11}$ and $R_{12}$ are methyl group.

8. A member according to claim 1 or 4, wherein $A_1$ is a divalent organic group represented by the following groups (i) or (ii):

$$-Ar_1- \quad \text{(i)},$$

wherein $Ar_1$ is substituted or unsubstituted aromatic hydrocarbon group or substituted or unsubstituted heterocyclic group; or $$-Ar_2-Y-Ar_3- \quad \text{(ii)},$$

wherein $Ar_2$ and $Ar_3$ independently is substituted or unsubstituted aromatic hydrocarbon group or substituted or unsubstituted heterocyclic group; and Y is oxygen atom, sulfur atom, substituted or unsubstituted alkylene group, carbonyl group or sulfonyl group.

9. A member according to claim 1 or 6, wherein $A_2$ is a divalent organic group represented by the following groups (i) or (ii):

$$-Ar_1- \quad \text{(i)},$$

wherein $Ar_1$ is substituted or unsubstituted aromatic hydrocarbon group or substituted or unsubstituted heterocyclic group; or $$-Ar_2-Y-Ar_3- \quad \text{(ii)},$$

wherein $Ar_2$ and $Ar_3$ independently is substituted or unsubstituted aromatic hydrocarbon group or substituted or unsubstituted heterocyclic group; and Y is oxygen atom, sulfur atom, substituted or unsubstituted alkylene group, carbonyl group or sulfonyl group.

10. A member according to claim 1, wherein said intermediate layer contains an electroconductive substance.

11. A member according to claim 1 or 10, wherein said intermediate layer comprises a first layer containing an electroconductive substance and a second layer containing no electroconductive substance.

12. A member according to claim 1, wherein said photosensitive layer comprises a charge generation layer and a charge transport layer.

13. A member according to claim 12, wherein said electroconductive support, said intermediate layer, said charge generation layer and said charge transport layer are disposed in this order.

14. A process cartridge, comprising: an electrophotographic photosensitive member according to claim 1 and at least one means selected from a charging means, a developing means, and a cleaning means;

wherein said photosensitive member, and said at least one means selected from the charging means, the developing means, and the cleaning means are integrally supported to form a single unit, which can be attached to or detached from an apparatus body as desired.

15. A cartridge according to claim 14, wherein said resin has a recurring unit (1).

16. A cartridge according to claim 14, wherein said resin has a recurring unit (2).

17. An electrophotographic apparatus, comprising: an electrophotographic photosensitive member according to claim 1, a charging means, an image-exposure means, a developing means and a transfer means.

18. An apparatus according to claim 17, wherein said resin has a recurring unit (1).

19. An apparatus according to claim 17, wherein said resin has a recurring unit (2).

* * * * *

UNITED STATES PATENT AND TRADEMARK OFFICE

CERTIFICATE OF CORRECTION

PATENT NO. : 5,464,718

DATED : November 7, 1995

INVENTOR : YOSHIO KASHIZAKI, ET AL.

It is certified that errors appear in the above-identified patent and that said Letters Patent is hereby corrected as shown below: Title page,

[56] References Cited

Foreign Patent Documents, "0632334 6/1994 European Pat. Off." should read --0632334 1/1995 European Pat. Off.--.

COLUMN 1

Line 20, "encountered" should read --encounter--;

Line 21, "ununiform" should read --non-uniform--;

Line 30, "ununiform," should read --non-uniform,--; and

Line 39, "ununiform," should read --non-uniform,--.

COLUMN 4

Line 22, "isopropylene-" should read --isopropylene.--.

COLUMN 27

Line 60, "Perkinelmer Co.)," should read --Perkin-Elmer Co.),--.

COLUMN 33

Line 36, "sec" should read --sec.--.

UNITED STATES PATENT AND TRADEMARK OFFICE

CERTIFICATE OF CORRECTION

PATENT NO. : 5,464,718

DATED : November 7, 1995

INVENTOR : YOSHIO KASHIZAKI, ET AL.

It is certified that errors appear in the above-identified patent and that said Letters Patent is hereby corrected as shown below:

COLUMN 34

Line 45, "0.8 sec/cycle" should read --0.8 sec./cycle--.

COLUMN 38

Line 44, "6 sec/cycle" should read --6 sec./cycle--.

COLUMN 39

Line 46, "is" should read --are--;

Line 60, "denotes" should read --is--; and

Line 61, "is" should read --are--.

COLUMN 40

Line 7, "atom." should read --atoms.--; and

UNITED STATES PATENT AND TRADEMARK OFFICE

CERTIFICATE OF CORRECTION

PATENT NO. : 5,464,718

DATED : November 7, 1995

INVENTOR : YOSHIO KASHIZAKI, ET AL.

It is certified that errors appear in the above-identified patent and that said Letters Patent is hereby corrected as shown below:

COLUMN 40,

Line 58, "claim 1" should read --claim 1,--.

Signed and Sealed this

Second Day of July, 1996

Bruce Lehman

*Attest:*

BRUCE LEHMAN

*Attesting Officer*

*Commissioner of Patents and Trademarks*